US008647798B2

(12) United States Patent
Asano et al.

(10) Patent No.: US 8,647,798 B2
(45) Date of Patent: Feb. 11, 2014

(54) PHOTORECEPTOR, PROCESS CARTRIDGE AND IMAGE FORMING APPARATUS

(75) Inventors: Tomoharu Asano, Shizuoka (JP); Hiroshi Ikuno, Kanagawa (JP); Akihiro Sugino, Shizuoka (JP); Hideo Nakamori, Shizuoka (JP); Mitsuaki Hirose, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/556,577

(22) Filed: Jul. 24, 2012

(65) Prior Publication Data

US 2013/0059242 A1 Mar. 7, 2013

(30) Foreign Application Priority Data

Sep. 1, 2011 (JP) ..... 2011-191042

(51) Int. Cl.
*G03G 5/07* (2006.01)

(52) U.S. Cl.
USPC ..... 430/66; 430/58.65; 430/58.7; 430/132

(58) Field of Classification Search
USPC ..... 430/58.65, 58.7, 66
See application file for complete search history.

(56) References Cited

U.S. PATENT DOCUMENTS

| | | | | |
|---|---|---|---|---|
| 5,411,827 | A | 5/1995 | Tamura et al. | |
| 5,496,671 | A | 3/1996 | Tamura et al. | |
| 2004/0043312 | A1 | 3/2004 | Kikuchi et al. | |
| 2006/0051688 | A1 | 3/2006 | Toda et al. | |
| 2007/0231720 | A1 | 10/2007 | Mori et al. | |
| 2008/0138725 | A1 | 6/2008 | Fujiwara et al. | |
| 2008/0298840 | A1 * | 12/2008 | Shimada | 399/159 |
| 2009/0269103 | A1 * | 10/2009 | Inaba et al. | 399/159 |

FOREIGN PATENT DOCUMENTS

| | | |
|---|---|---|
| JP | 5-216249 | 8/1993 |
| JP | 2000-206715 | 7/2000 |
| JP | 2005-140825 | 6/2005 |
| JP | 2006-99028 | 4/2006 |
| JP | 2007-293247 | 11/2007 |
| JP | 2008-197632 | 8/2008 |
| JP | 2010-152180 | 7/2010 |

* cited by examiner

*Primary Examiner* — Peter Vajda
(74) *Attorney, Agent, or Firm* — Oblon, Spivak, McClelland, Maier & Neustadt, L.L.P.

(57) ABSTRACT

A photoreceptor including an electroconductive substrate; a photosensitive layer on the electroconductive substrate; and a protection layer on the photosensitive layer, wherein the protection layer includes a radical polymerizable compound having three or more radical polymerizable groups without a charge transportable group, a monofunctional radical polymerizable compound having a specific charge transportable group and a non-radical polymerizable compound having a specific charge transportable group.

10 Claims, 3 Drawing Sheets

PHOTORECEPTOR, PROCESS CARTRIDGE AND IMAGE FORMING APPARATUS

CROSS-REFERENCE TO RELATED APPLICATIONS

This patent application is based on and claims priority pursuant to 35 U.S.C. §119 to Japanese Patent Application No. 2011-191042 filed on Sep. 1, 2011, in the Japanese Patent Office, the entire disclosure of which is hereby incorporated herein by reference.

FIELD OF THE INVENTION

The present invention relates to a photoreceptor, a process cartridge and image forming apparatus.

BACKGROUND OF THE INVENTION

A photoreceptor need to have a capability of holding a surface charge in the dark, a capability of generating a charge upon receipt of light and a capability of transporting a charge upon receipt of light. A single-layered photoreceptor having these capabilities in one layer and a functionally—separated multilayered photoreceptor having a layer mainly generating a charge and a layer holding a charge in the dark and transporting a charge upon receipt of light are known.

When an image is formed using a photoreceptor, the photoreceptor is charged in the dark by corona discharge, the charged photoreceptor is irradiated to form an electrostatic latent image, the electrostatic latent image formed on the photoreceptor is developed with a toner to form a toner image, the toner image is transferred and fixed on a recording medium such as papers, and the photoreceptor is discharged and the toner remaining thereon is removed after the toner image in transferred.

Organic photoreceptors have practically been used recently because of their advantages such as flexibility, thermostability and film formability.

Further, electrophotographic image forming apparatuses are rapidly required to produce better quality full-color images and at higher speed. In addition, they are demanded not only in typical office fields, but also in SOHO or light printing fields. Particularly, in the light printing fields, the printing volume noticeably increases and the image quality stability is more required. Therefore, it is indispensable for the organic photoreceptors to have durability.

Some photoreceptors are known to include protection layers on their surfaces. Methods of irradiating light or an electron beam are known to form the protection layers.

Japanese published unexamined application No. 2005-140825 discloses an electrophotographic photoreceptor including an electroconductive substrate, and a charge generation layer, a charge transport layer and a crosslinked charge transport layer sequentially layered on the substrate. The crosslinked charge transport layer is formed by crosslinking a tri- or more functional radical polymerizable monomer without a charge transportable structure and a monofunctional radical polymerizable compound having a charge transportable structure.

However, this is required to improve gas resistance and prevent production of images having uneven image density when used for long periods.

Because of these reasons, a need exist for a photoreceptor having good durability and gas resistance and preventing production of images having uneven image density even when used for long periods.

SUMMARY OF THE INVENTION

Accordingly, one object of the present invention to provide a photoreceptor having good durability and gas resistance and preventing production of images having uneven image density even when used for long periods.

Another object of the present invention to provide a method of preparing the photoreceptor.

A further object of the present invention to provide a process cartridge using the photoreceptor.

Another object of the present invention to provide an image forming apparatus using the photoreceptor.

These objects and other objects of the present invention, either individually or collectively, have been satisfied by the discovery of a photoreceptor, comprising:

an electroconductive substrate;

a photosensitive layer overlying the electroconductive substrate; and a protection layer overlying the photosensitive layer, wherein the protection layer is formed by crosslinking a composition comprising a radical polymerizable compound having three or more radical polymerizable groups without a charge transportable group, a compound having the following formula (1):

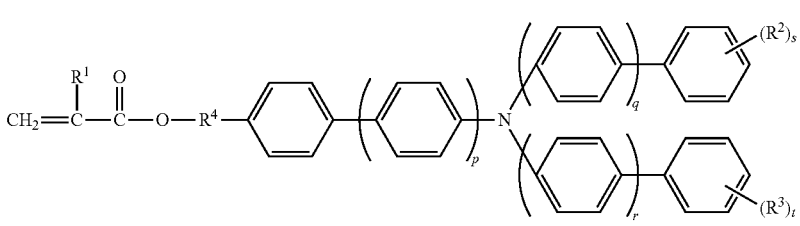

wherein p, q and r independently represent an integer of from 0 to 2; s and t independently represent an integer of from 0 to 3; $R^1$ represents a hydrogen atom or a methyl group; $R^2$ and $R^3$ independently represent an alkyl group having 1 to 5 carbon atoms wherein plural $R^2$ may be different from each other when s is 2 or 3 and $R^3$ may be different from each other when t is 2 or 3; and $R^4$ represents a single bond, a methylene group, an ethylene group, an ethyleneoxy group, a 2-methyl-ethyleneoxy group or a phenyleneethylene group, and a compound having the following formula (2):

(2)

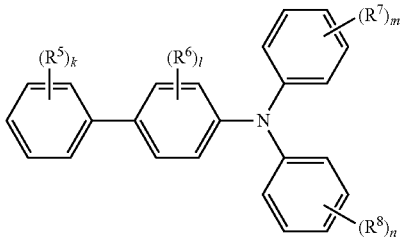

wherein $R^5$, $R^7$ and $R^8$ independently represent a hydrogen atom, an amino group, an alkoxy group, a thioalkoxy group, an aryloxy group, a methylenedioxy group, an alkyl group optionally having a substituent, a halo group or an aryl group optionally having a substituent; $R^6$ represents a hydrogen atom, an alkoxy group, an alkyl group optionally having a substituent or a halo group; k, l, m and n independently represent an integer of from 1 to 4 wherein plural $R^5$ may be different from each other when k is an integer of from 2 to 4, plural $R^6$ may be different from each other when l is an integer of from 2 to 4, plural $R^7$ may be different from each other when m is an integer of from 2 to 4 and plural $R^8$ may be different from each other when n is an integer of from 2 to 4.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
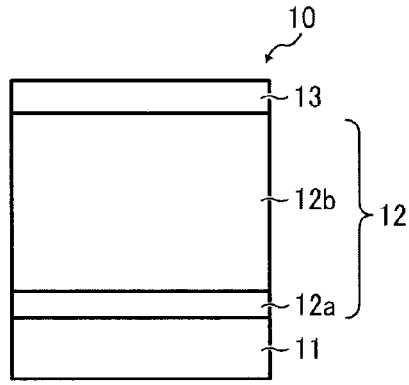
FIG. 1 is a cross-sectional view of an embodiment of the photoreceptor of the present invention.

The present invention provides a photoreceptor having good durability and gas resistance and preventing production of images having uneven image density even when used for long periods.

More particularly, the present invention relates to a photoreceptor, comprising:

an electroconductive substrate;

a photosensitive layer overlying the electroconductive substrate; and a protection layer overlying the photosensitive layer, wherein the protection layer is formed by crosslinking a composition comprising a radical polymerizable compound having three or more radical polymerizable groups without a charge transportable group, a compound having the following formula (1):

(1)

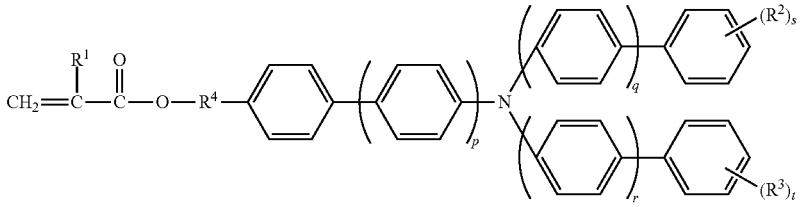

wherein p, q and r independently represent an integer of from 0 to 2; s and t independently represent an integer of from 0 to 3; $R^1$ represents a hydrogen atom or a methyl group; $R^2$ and $R^3$ independently represent an alkyl group having 1 to 5 carbon atoms wherein plural $R^2$ may be different from each other when s is 2 or 3 and $R^3$ may be different from each other when t is 2 or 3; and $R^4$ represents a single bond, a methylene group, an ethylene group, an ethyleneoxy group, a 2-methylethyleneoxy group or a phenyleneethylene group, and a compound having the following formula (2):

(2)

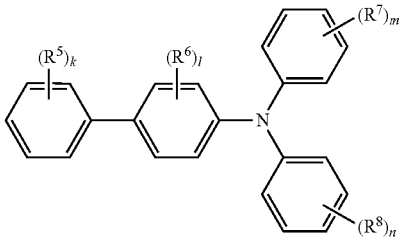

wherein $R^5$, $R^7$ and $R^8$ independently represent a hydrogen atom, an amino group, an alkoxy group, a thioalkoxy group, an aryloxy group, a methylenedioxy group, an alkyl group optionally having a substituent, a halo group or an aryl group optionally having a substituent; $R^6$ represents a hydrogen atom, an alkoxy group, an alkyl group optionally having a substituent or a halo group; k, l, m and n independently represent an integer of from 1 to 4 wherein plural $R^5$ may be different from each other when k is an integer of from 2 to 4, plural $R^6$ may be different from each other when l is an integer of from 2 to 4, plural $R^7$ may be different from each other when m is an integer of from 2 to 4 and plural $R^8$ may be different from each other when n is an integer of from 2 to 4.

FIG. 1 is a cross-sectional view of an embodiment of the photoreceptor of the present invention. A photoreceptor 10 includes an electroconductive substrate 11, a photosensitive layer 12 formed of a charge generation layer 12*a* and a charge transport layer 12*b* on the substrate, and a protection layer 13 on the photosensitive layer.

The protection layer 13 is formed by crosslinking a crosslinkable composition including a radical polymerizable compound having three or more radical polymerizable groups, i.e. a tri- or more functional radical polymerizable compound without a charge transportable group, a monofunctional radical polymerizable compound having a charge transportable group and the formula (1), and a non-radical polymerizable compound having a charge transportable group, no radical polymerizable group and the formula (2).

When the crosslinkable composition including the tri- or more functional radical polymerizable compound without a charge transportable group and the compound having the formula (1) are crosslinked, a three-dimensional network structure is formed and the photoreceptor 10 improves in durability. Then, a structural unit from the compound having the formula (1) forms a hanging structure like a pendant in the three-dimensional network structure, and a space is thought to form around the bulky charge transportable group.

Then, the crosslinkable composition including the compound having the formula (2) is further crosslinked to decrease the space and improve gas resistance, and it is thought production of images having uneven image density when used for long periods is prevented.

In the present invention, specific examples of the charge transportable group the radical polymerizable compound does not have include, but are not limited to, hole transportable groups such as groups in which a hydrogen atom is removed from triarylamine, hydrazone, pyrazoline, and carbazole, etc.; and electron transportable groups such as groups in which a hydrogen atom is removed from aromatic series having an electron withdrawable group such as condensed polycyclic quinone, diphenoquinone, a cyano group or a nitro group.

In the present invention, as the radical polymerizable groups the radical polymerizable compound has, any radical polymerizable groups having a carbon-carbon double bond can be used. Suitable radical polymerizable groups include a group in which one hydrogen atom is removed from a substituent of monosubstituted ethylene group and a group in which one hydrogen atom is removed from a substituent of 1,1-disubstituted ethylene group. Particularly, an acryloyloxy group or a methacryloyloxy group is preferably used.

The group in which one hydrogen atom is removed from a substituent of monosubstituted ethylene group includes $CH_2{=}CH{-}X^1$ —wherein $X^1$ represents an arylene group optionally having a substituent such as a phenylene group and a naphthylene group, an alkenylene group optionally having a substituent, a carbonyl group and a carbonyloxy group, and —$CONR^1$ wherein $R^1$ represents a hydrogen atom, an alkyl group such as and an ethyl group, an alkyl group such as an ethyl group, an aralkyl group such as a benzyl group, a naphthylmethyl group and a phenetyl group and an aryl group such as a phenyl group and a naphthyl group.

Specific examples of the group in which one hydrogen atom is removed from a substituent of monosubstituted ethylene group include a styryl group, 2-methyl-1,3-butadienyl group, a vinylcarbonyl group, an acryloyloxy group, an acryloylamide group, a vinylthio group, etc.

The group in which one hydrogen atom is removed from a substituent of 1,1-disubstituted ethylene group include $CH_2{=}CY{-}X^2$ —wherein Y represents an alkyl group optionally having a substituent, an aralkyl group optionally having a substituent, an aryl group optionally having a substituent such as a phenyl group and a naphthyl group, a halo group, a cyano group, a nitro group, an alkoxyl group, a —$COOR^2$ wherein $R^2$ represents a hydrogen atom, an alkyl group optionally having a substituent such as a methyl group and an ethyl group, an aralkyl group optionally having a substituent such as a benzyl group and a phenethyl group, an aryl group optionally having a substituent such as a phenyl group and a naphthyl group or a —$CONR^3R^4$ wherein $R^3$ and $R^4$ independently represent a hydrogen atom, an alkyl group optionally having a substituent such as a methyl group and an ethyl group, an aralkyl group optionally having a substituent such as a benzyl group and a phenethyl group, an aryl group optionally having a substituent such as a phenyl group and a naphthyl group; and $X^2$ represents the same groups in $X^1$, a single bond or an alkylene group, an Y and/or $X^2$ is an oxycarbonyl group, a cyano group, an alkenylene group or an aromatic group.

Specific examples of the group in which one hydrogen atom is removed from a substituent of 1,1-disubstituted ethylene group include an α-chloroacryloyloxy group, a methacryloyloxy group, an α-cyanoethylene group, an α-cyanoacryloyloxy group, an α-cyanophenylene group, a methacryloylamino group, etc.

Specific examples of the substituents $X^1$, $X^2$ and Y have include, but are not limited to, a halo group, a nitro group, a cyano group, an alkyl groups such as a methyl group and an ethyl group, an alkoxy group such as a methoxy group and an ethoxy group, an aryloxy group such as a phenoxy group, an aryl group such as a phenyl group and a naphthyl group, an aralkyl group such as a benzyl group and a phenethyl group, etc.

A compound having three or more acryloyloxy groups can be prepared by subjecting a compound including three or more hydroxyl groups and an acrylic acid (salt), an acrylic acid halide or an acrylic acid ester to an ester reaction or an ester exchange reaction. Further, a compound having a methacryloyloxy group can similarly be prepared as well.

Radical polymerizable groups the tri- or more functional radical polymerizable compound without a charge transportable group has may be the same or different from each other.

Specific examples of the tri- or more functional radical polymerizable compounds without a charge transportable group include trimethylolpropane triacrylate (TMPTA), trimethylolpropane trimethacrylate, trimethylolpropanealkylene-modified triacrylate, trimethylolpropaneethyleneoxy-modified (hereafter EO-modified) triacrylate, trimethylolpropanepropyleneoxy-modified (hereafter PO-modified) triacrylate, trimethylolpropanecaprolactone-modified triacrylate, trimethylolpropanealkylene-modified trimethacrylate, pentaerythritol triacrylate, pentaerythritol tetracrylate (PETTA), glycerol triacrylate, glycerol epichlorohydrin-modified (hereafter ECH-modified) triacrylate, glycerol EO-modified triacrylate, glycerol PO-modified triacrylate, tris(acryloxyethyl)isocyanurate, dipentaerythritol hexaacrylate (DPHA), dipentaerythritolcaprolactone-modified hexaacrylate, dipentaerythritolhydroxy pentaacrylate, alkylated dipentaerythritol pentacrylate, alkylated dipentaerythritol tetraacrylate, alkylated dipentaerythritol triacrylate, dimethylolpropane tetraacrylate (DTMPTA), pentaerythritolethoxy tetraacrylate, phosphoric acid EO-modified triacrylate, and 2,2,5,5-tetrahydroxymethylcyclopentanone tetracrylate. These can be used alone or in combination.

A molecular weight ratio of the tri- or more functional radical polymerizable compound without a charge transportable group to the radical polymerizable functional group number is preferably 250 or less. When greater than 250, the photoreceptor 10 occasionally deteriorates rather in abrasion resistance.

The crosslinkable composition typically includes the tri- or more functional radical polymerizable compound without a charge transportable group in an amount of 20 to 80%, and preferably from 35 to 65% by weight. When less than 20% by weight, the photoreceptor 10 occasionally deteriorates in abrasion resistance. When greater than 80% by weight, the photoreceptor 10 occasionally increases in residual potential.

Specific examples of the compound having the formula (1) include, but are not limited to, the following compounds having the formulae (1-1) to (1-3):

(1-1)

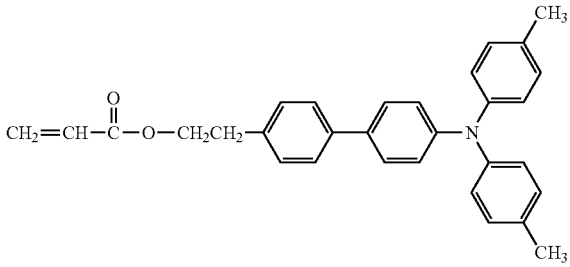

(1-2)

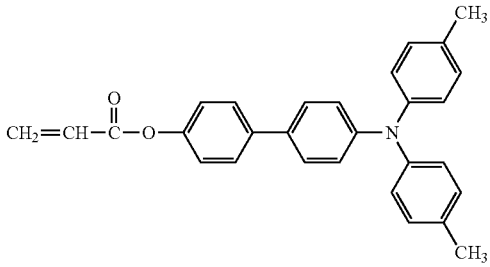

(1-3)

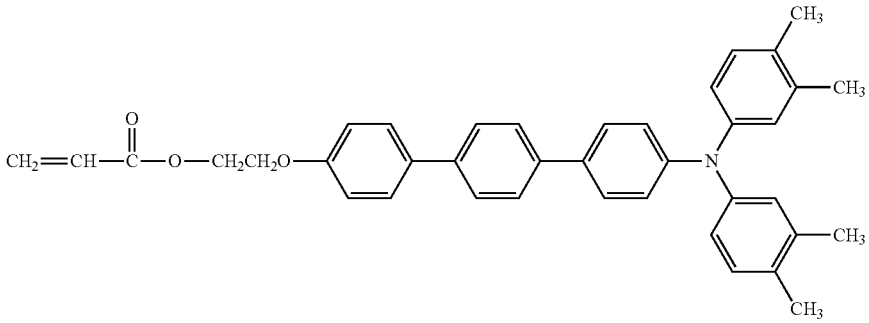

The compound having the formula (2) has a group in which one hydrogen atom is removed form triarylamine as the compound having the formula (1), and is thought to decrease a space formed around a charge transportable group of the three-dimensional network structure.

Specific examples of the compound having the formula (2) include, but are not limited to, the following compounds having the formulae (2-1) to (2-3):

(2-1)

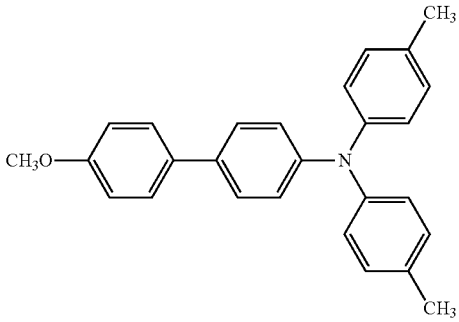

-continued (2-2)

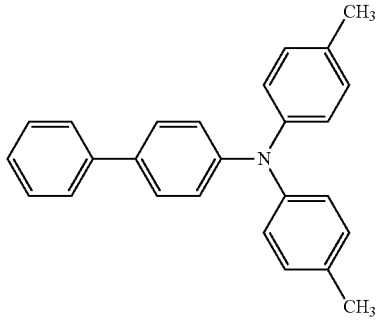

(2-3)

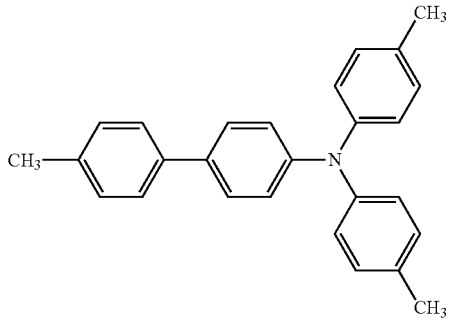

A ratio of a total weight of the compounds having the formulae (1) and (2) to a weight of the tri- or more functional radical polymerizable compound without a charge transportable group is typically from 0.2 to 4, and preferably from 0.2 to 2. When less than 0.2, the photoreceptor 10 occasionally increases in residual potential. When greater than 4, the photoreceptor 10 occasionally deteriorates in abrasion resistance.

A weight ratio of the compound having the formula (2) to the compound having the formula (1) is typically from 0.2 to 4, and preferably from 0.25 to 2. When less than 0.2, the photoreceptor 10 occasionally deteriorates in gas resistance. When greater than 4, the photoreceptor 10 occasionally deteriorates in abrasion resistance.

Further, the crosslinkable composition preferably includes an inorganic particulate material or a particulate resin. The photoreceptor 10 further improves in abrasion resistance.

Specific examples of the inorganic particulate material include, but are not limited to, particulate metals such as particulate copper, particulate tin, particulate aluminium and particulate indium; particulate metal oxides such as particulate silicon dioxide, particulate aluminum oxide, particulate tin dioxide, particulate zinc oxide, particulate titanium oxide, particulate indium oxide, particulate antimony oxide and particulate bismuth oxide; kalium titanate, particulate a-carbon, etc. Specific examples of the particulate resin include, but are not limited to, fluorine-containing particulate resins such as polytetrafluoroethylene, particulate silicone resins, etc. The particulate material or the particulate resin can be used alone or in combination. Inconsideration of the abrasion resistance of the photoreceptor 10, the inorganic particulate materials are preferably, and the particulate metal oxides such as the particulate silicon dioxide, the particulate aluminum oxide and the particulate titanium oxide are more preferably used. Colloidal silica and colloidal alumina may be used as the particulate metal oxides.

The particulate material or the particulate resin preferably has an average primary particle diameter of from 0.01 to 0.5 μm. When less than 0.01 μm, the photoreceptor 10 occasionally deteriorates in abrasion resistance. When greater than 0.5 μm, the photoreceptor 10 occasionally has toner filming on its surface.

The crosslinkable composition typically includes the particulate material or the particulate resin in an amount of from 5 to 50% by weight, and preferably from 5 to 30% by weight. When less than 5% by weight, the photoreceptor 10 does not occasionally improve in abrasion resistance. When greater than 50% by weight, the photoreceptor 10 occasionally increases in residual potential.

The inorganic particulate material is preferably subjected to surface treatment with a surface treatment agent. The photoreceptor 10 further improves in abrasion resistance.

Specific examples of the surface treatment agent include, but are not limited to, a titanate coupling agent, an aluminum coupling agent, zircoaluminate coupling agent, higher fatty acids, a silane coupling agent, aluminum oxide, titanium oxide, zirconium dioxide, silicone, aluminum stearate, etc. These can be used alone or in combination.

The inorganic particulate material is typically subjected to surface treatment in an amount of from 3 to 30% by weight, and preferably from 5 to 20% by weight, based on total weight thereof. When less than 3% by weight, the photoreceptor 10 does not occasionally improve in abrasion resistance. When greater than 30% by weight, the photoreceptor 10 occasionally increases in residual potential.

Coating a coating liquid including the crosslinkable composition on the photosensitive layer 12 formed on the electroconductive substrate 11 and irradiating the coated liquid with light or an electron beam to crosslink the composition to form the protection layer 13 thereon.

In the present invention, the crosslinkable composition may further include a non-radical polymerizable polymer, a mono- or difunctional radical polymerizable polymer having no charge transportability and a radical polymerizable oligomer to adjust viscosity of the coating liquid, relieve stress of the protection layer 13, lower the surface energy and decrease friction coefficient.

Specific examples of the non-radical polymerizable polymer include, but are not limited to, polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins, etc.

Specific examples of the monofunctional radical monomer having no charge transportability include, but are not limited to, 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, styrene monomer, etc.

Specific examples of the difunctional radical monomer having no charge transportability include, but are not limited to, 1,3-butanediolacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, EO-modified bisphenol F diacrylate, etc.

Specific examples of the radical polymerizable oligomer include, but are not limited to, epoxyacrylate oligomers, urethaneacrylate oligomers and polyetseracrylate oligomers.

A ratio of a total weight of the non-radical polymerizable polymer, the mono- or difunctional radical polymerizable polymer having no charge transportability and the radical polymerizable oligomer to a weight of the tri- or more functional radical polymerizable compound having no charge transportability is typically not greater than 0.5, and preferably not greater than 0.3. When greater than 0.5, the photoreceptor 10 occasionally deteriorates in abrasion resistance.

The crosslinkable composition may further include a photopolymerization initiator to efficiently be crosslinked.

Specific examples of the photopolymerization initiator include, but are not limited to, acetone or ketal photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-molpholinophenyl)butanone-1,2-hydroxy-2-methyl-1-phenylpropane-1-one and 1-phenyl-1,2-propanedion-2-(o-ethoxycarbonyl)oxime; benzoinether photopolymerization initiators such as benzoin, benzoinmethylether, 1-benzomethylether, benzoinisobutylether and benzoinisopropylether; benzophenone photopolymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photopolymerization initiators such as 2-isopropylthioxanthone, 2-chlorothioxanthone, 2,4-dimethylthioxanthone, 2,4-diethylthioxanthone and 2,4-dichlorothioxanthone; and other photopolymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds and imidazole compounds. These can be used alone or in combination.

A weight ratio of the photopolymerization initiator to the materials having a radical polymerizable group is typically from 0.005 to 0.4, and preferably from 0.01 to 0.2.

The crosslinkable composition may further include an accelerator together with the photopolymerization initiator.

Specific examples of the accelerator include, but are not limited to, triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone.

The crosslinkable composition may further include a plasticizer, a leveling agent and a non-radical polymerizable compound having a charge transportable group besides the compound having the formula (2).

Specific examples of the plasticizer include, but are not limited to, dibutylphthalate and dioctylphthalate, etc.

The crosslinkable composition typically includes the plasticizer in an amount not greater than 30% by weight, and preferably not greater than 10% by weight.

Specific examples of the leveling agents include, but are not limited to, silicone oil such as dimethylsilicone oil and methylphenylsilicone oil; and polymers and oligomers having a perfluoroalkyl group in the side chain.

The crosslinkable composition includes the leveling agent in an amount not greater than 3% by weight.

The crosslinkable composition may include a solvent or may not include a solvent when including a liquid.

Specific examples of the solvent include alcohols such as methanol, ethanol, propanol and butanol; ketones such as acetone, methyl ethyl ketone, methyl isobutyl ketone and cyclohexanone; esters such as ethylacetate and butylacetate; ethers such as tetrahydrofuran, dioxane and propylether; halogens such as dichloromethane, dichloroethane, trichloroethane and chlorobenzene; aromatics such as benzene, toluene and xylene; and cellosolves such as methylcellosolve, ethylcellosolve and cellosolve acetate. These solvents can be used alone or in combination.

Specific examples of methods of coating a coating liquid including the crosslinkable composition include, but are not limited to, dip coating methods, spray coating methods, bead coating methods, ring coating methods, etc.

Specific examples of light sources irradiating light include, but are not limited to, UV irradiators such as high pressure mercury lamps and metal halide lamps having an emission wavelength of UV light; and a visible light source adaptable to absorption wavelength of the radical polymerizable compounds and photopolymerization initiators.

An illuminance is from 50 to 1,000 mW/cm$^2$. A drum-shaped electroconductive substrate 11 a coating liquid including the crosslinkable composition is coated on is irradiated with UV having an illuminance of 70 mW/cm$^2$ for about 2 min while rotated.

Inconsideration of crosslinkability of the crosslinkable composition, a coated film preferably has a surface temperature of 20 to 170° C. when irradiated.

Specific examples of methods of controlling the surface temperature of the coated firm include, but are not limited to, methods of controlling temperature using a heating medium.

After the crosslinkable composition is crosslinked, the coated film is preferably heated at 100 to 150° C. for 10 to 30 min to reduce a residual solvent.

The protection layer 13 has a thickness of from 1 to 30 μm, preferably from 2 to 20 μm, and more preferably from 3 to 10 μm. When less than 1 μm, the photoreceptor occasionally deteriorates in durability. When greater than 30 μm, photoreceptor occasionally increases in residual potential.

Suitable materials for use as the electroconductive substrate 11 include materials having a volume resistance not greater than $1\times10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can be also used as the substrate. Further, endless belts of a metal such as nickel and stainless steel, which have been disclosed in Japanese published unexamined application No. 52-36016, can be also used as the electroconductive substrate 11.

Furthermore, substrates, on which an electroconductive layer including a binder resin and an electroconductive particulate material is formed can be used as the electroconductive substrate 11.

Specific examples of such an electroconductive particulate material include, but are not limited to, carbon black, acetylene black, particulate metals such as aluminum, nickel, iron, Nichrome, copper, zinc, silver, and metal oxides such as tin oxides and ITO.

Specific examples of the binder resin include, but are not limited to, polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins, etc.

The electroconductive layer can be formed by coating a coating liquid in which the electroconductive particulate material powder and the binder resin are dissolved or dispersed in a solvent such as tetrahydrofuran, dichloromethane, methyl ethyl ketone, toluene, etc.

When a cylindrical substrate is used, a heat-shrinkable tube including a resin such as polyvinyl chloride, polypropylene, polyesters, polyvinylidene chloride, polyethylene, chlorinated rubber and TEFLON (registered trademark) and the electroconductive particulate material may be used to form an electroconductive layer.

The charge generation layer 12*a* includes a charge generation material and may further include a binder resin when necessary.

Specific examples of the charge generation material include, but are not limited to, monoazo pigments, disazo pigments, trisazo pigments, perylene pigments, perynone pigments, quinacridone pigments, quinone type condensed polycyclic compounds, squaric acid type dyes, other phthalocyanine pigments, naphthalocyanine pigments, azulenium salt dyes, etc. These charge generation materials can be used alone or in combination.

Specific examples of the binder resin include, but are not limited to, polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinylcarbazole, polyacrylamide, polyvinyl benzal, polyesters, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, etc.

A weight ratio of the binder resin to the charge generation material is typically from 0 to 5, and preferably from 0.1 to 3.

The charge generation layer 12*a* may further include a sensitizer, a dispersant, a surfactant, silicone oil, etc.

The charge generation layer 12*a* typically has a thickness of from 0.01 to 5 μm, and preferably from 0.1 to 2 μm.

The charge generation layer 12*a* is formed by coating a coating liquid in which the charge generation material is dispersed in a solvent on the electroconductive substrate 11.

Specific examples of dispersers used for dispersing a charge generation material in a solvent include, but are not limited to, a ball mill, an attritor, a sand mill, a supersonic disperser, etc Specific examples of the solvents include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, etc. In particular, ketone type solvents, ester type solvents and ether type solvents are preferably used. These can be used alone or in combination.

Specific examples of methods of coating a coating liquid include, but are not limited to, dip coating methods, spray coating methods, bead coating methods, nozzle coating methods, spinner coating methods, ring coating methods, etc.

The charge transport layer 12*b* includes a charge transport material and a binder resin.

Specific examples of the charge transport material include hole transport materials such as poly(N-carbazole) and its derivatives, poly(γ-carbazolylethylglutamate) and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, etc. These can be used alone or in combination.

Specific examples of the binder resin include, but are not limited to, thermoplastic resins or thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins and alkyd resins.

A weight ratio of the charge transport material to the binder resin is from 0.3 to 2. When less than 0.3, the photoreceptor 10 occasionally increases in residual potential. When greater than 2, the photoreceptor 10 occasionally deteriorates in abrasion resistance.

The charge transport layer typically has a thickness of from 5 to 50 μm, and preferably from 5 to 25 μm.

The charge transport layer 12*b* is formed by coating a coating liquid in which the charge transport material is dissolved or dispersed in a solvent on the charge generation layer 12*a* formed on the electroconductive substrate 11.

Specific examples of the solvent include, but are not limited to, tetrahydrofuran, dioxane, toluene, dichloromethane, monochlorobenzene, dichloroethane, cyclohexanone, methyl ethyl ketone, acetone, diethylether, etc. These can be used alone or in combination.

Specific examples of methods of coating the coating liquid include, but are not limited to, dip coating methods, spray coating methods, bead coating methods, nozzle coating methods, spinner coating methods, ring coating methods, etc.

Figure 2:
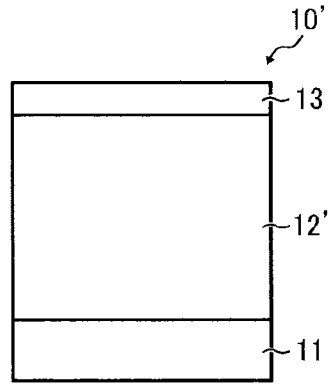
FIG. 2 is a cross-sectional view of another embodiment of the photoreceptor of the present invention.

FIG. 2 is a cross-sectional view of another embodiment of the photoreceptor of the present invention. A photoreceptor 10' includes an electroconductive substrate 11, a photosensitive layer 12' on the substrate, and a protection layer 13 on the photosensitive layer.

The photosensitive layer 12' includes a charge generation material, a charge transport material and a binder resin.

As the charge generation material, the charge generation materials for use in the charge generation layer 12*a* can be used.

As the charge transport material, the charge transport materials for use in the charge transport layer 12*b* can be used.

As the binder resin, the binder resins for use in the charge transport layer 12*b* can be used.

The photosensitive layer 12' typically includes the charge generation material in an amount of from 0.1 to 30% by weight, and preferably from 0.5 to 5% by weight. When less than 0.1% by weight, the photoreceptor 10' occasionally deteriorates in sensitivity. When greater than 30% by weight, the photoreceptor 10' occasionally deteriorates in chargeability or abrasion resistance.

A weight ratio of the charge transport material to the binder resin is from 0.3 to 2. When less than 0.3, the photoreceptor 10 occasionally increases in residual potential. When greater than 2, the photoreceptor 10 occasionally deteriorates in abrasion resistance.

The photosensitive layer 12' typically has a thickness of from 5 to 50 μm, and preferably from 5 to 25 μm.

The photosensitive layer 12' is formed by coating a coating liquid in which the charge generation material, the charge transport material and the binder resin are dissolved or dispersed in a solvent on the electroconductive substrate 11.

As the solvent, the solvents for use in the charge transport layer 12*b* can be used.

As methods of coating the coating liquid, the methods of forming the charge transport layer 12*b* can be used.

An intermediate layer including a binder resin may be formed between the photosensitive layer 12 or 12' and the protection layer 13.

Specific examples of the resin include, but are not limited to, polyamides, alcohol soluble nylons, water-soluble polyvinyl butyral, polyvinyl butyral, polyvinyl alcohol, etc.

The intermediate layer is formed by coating a coating liquid in which the binder resin is dissolved or dispersed in a solvent on the photosensitive layer 12 or 12'formed on the electroconductive substrate 11.

Specific examples of the solvents include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, etc. In particular, ketone type solvents, ester type solvents and ether type solvents are preferably used. These can be used alone or in combination.

Specific examples of methods of coating a coating liquid include, but are not limited to, dip coating methods, spray coating methods, bead coating methods, nozzle coating methods, spinner coating methods, ring coating methods, etc.

The intermediate layer typically has a thickness of from 0.05 to 2 μm.

An undercoat layer including a resin may be formed between the electroconductive substrate 11 and the photosensitive layer 12 or 12'.

Specific examples of the resin include, but are not limited to, water-soluble resins such as polyvinyl alcohol resins, casein and polyacrylic acid sodium salts; alcohol soluble resins such as nylon copolymers and methoxymethylated nylon resins; and thermosetting resins such as polyurethane resins, melamine resins, alkyd-melamine resins, epoxy resins, etc.

The undercoat layer may include a particulate metal oxide to prevent occurrence of moiré in the produced images and to decrease residual potential of the photoreceptor.

Specific examples of the metal oxide include, but are not limited to, titanium oxide, silica, alumina, zirconium oxide, tin oxide, indium oxide, etc.

The undercoat layer is formed by coating a coating liquid in which the binder resin is dissolved or dispersed in a solvent on the electroconductive substrate 11.

Specific examples of the solvents include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, etc. In particular, ketone type solvents, ester type solvents and ether type solvents are preferably used. These can be used alone or in combination.

Specific examples of methods of coating a coating liquid include, but are not limited to, dip coating methods, spray coating methods, bead coating methods, nozzle coating methods, spinner coating methods, ring coating methods, etc.

The undercoat layer may be formed by subjecting the electroconductive substrate 11 to surface treatment with a surface treatment agent such as a silane coupling agent, a titanium coupling agent or a chromium coupling agent.

When aluminum forms the electroconductive substrate 11, an anodic oxidation method may be used to form the undercoat layer thereon.

The undercoat layer may be formed by a vacuum thin-film forming method using an organic compound such as polyparaxylylene (parylene) or an inorganic compound such as silicon dioxide, tin dioxide, titanium oxide, ITO and cerium oxide.

The undercoat layer typically has a thickness of from 0 to 5 μm.

The charge generation layer 12*a*, the charge transport layer 12*b*, the photosensitive layer 12', the intermediate layer or the undercoat layer may further include an antioxidant, a plasticizer, a lubricant, an UV absorber, a leveling agent, etc.

The image forming apparatus of the present invention is not particularly limited if including the photoreceptor of the present invention, a charger charging the photoreceptor, an irradiator irradiating the charged photoreceptor to form an electrostatic latent image, an image developer developing the electrostatic latent image formed on the photoreceptor to form a toner image, and a transferer transferring the toner image formed on the photoreceptor onto a recording medium.

The image forming apparatus of the present invention may further include a fixer fixing the toner image transferred onto the recording medium, a discharger discharging the photoreceptor after the toner image is transferred therefrom, a cleaner cleaning the toner remaining on the photoreceptor after the toner image is transferred therefrom, a recycler recycling the cleaned toner in the image developer, a controller controlling operations of the means, etc. when necessary.

The charger is not particularly limited if capable of applying a voltage to the surface of the photoreceptor to uniformly charge the photoreceptor. Specific examples of the charger include contact chargers. e.g., electroconductive or semiconductive rollers, brushes such as magnetic brushes and fur brushes, and chargers having a charging member such as a film and a rubber blade; and non-contact chargers, e.g., corona chargers such as corotron and scorotron. Particularly, the non-contact chargers are preferably used because of reducing ozone generated from the charger.

The contact charger having a magnetic brush includes a non-magnetic electroconductive sleeve and a magnet roll included in the electroconductive sleeve.

Materials forming the magnetic brush are not particularly limited, but particulate ferrite such as particulate Zn—Cu ferrite is preferably used.

The fur brush is formed by winding or attaching a fur subjected to an electroconductive treatment with, e.g., carbon, copper sulfide, metals and metal oxides around or to a metallic bar or a bar subjected to an electroconductive treatment.

The charger preferably applies a DC voltage overlapped with an AC voltage to the charging member. The charging member is preferably a charging roller located close to and not in contact with the photoreceptor through a gap tape.

The irradiator is not particularly limited, provided that the irradiator can irradiate the surface of the photoreceptor with imagewise light, and reprographic optical irradiators, rod lens array irradiators, laser optical irradiators and a liquid crystal shutter optical irradiators can be used.

The irradiator is preferably a digital irradiator.

Backside irradiation methods irradiating the surface of the photoreceptor through the backside thereof may be used.

The image developer is not particularly limited, provided that the image developer can develop an electrostatic latent image formed on the photoreceptor with a toner. For example, an image developer containing a toner or a developer including a toner and a carrier and being capable of imparting the toner to the electrostatic latent image is preferably used.

The image developer may use a dry developing method or a wet developing method, may develop a single color or multiple colors, and preferably includes a stirrer stirring the toner or developer to be charged and a rotatable magnet roller. When the developer including the toner and the carrier is mixed and stirred, the toner and the carrier are charged and held on the surface of the magnet roller in the shape of an ear to form a magnetic brush. Since the magnet roller is located close to the photoreceptor, a part of the toner forming the magnetic brush on the surface of the magnet roller is electrically attracted to the surface of the photoreceptor. Consequently, the electrostatic latent image is developed with the toner to form a toner image thereon.

The transferer is not particularly limited, provided the transferer can transfer the toner image formed on the photoreceptor onto a recording medium. Corona chargers, rollers, pressure rollers, etc. can be used.

The transferer preferably includes a first transferer transferring the toner image formed on the photoreceptor onto an intermediate transferer and a second transferer transferring the toner image transferred on the intermediate transferer onto the recording medium.

The intermediate transferer is not particularly limited, and an endless belt, etc. can be used.

The recording medium is not particularly limited, and a plain paper, a PET film for OHP, etc. can be used.

The fixer is not particularly limited, provided the fixer can fix the toner image on the recording medium. A fixer including a heating roller and a pressure roller; a fixer including a heating roller, a pressure roller and an endless belt, etc. can be used.

The heating roller typically has a temperature of from 80 to 200° C.

A known optical fixer may be used with or instead of the fixer.

The discharger is not particularly limited, provided the discharger can discharge the photoreceptor after the toner image is transferred therefrom. A discharge lamp, etc can be used.

The cleaner is not particularly limited, provided the cleaner can clean the toner remaining on the photoreceptor after the toner image is transferred therefrom. A magnetic brush cleaner, an electrostatic brush cleaner, a magnetic roller cleaner, a blade cleaner, a brush cleaner and a web cleaner can be used.

The recycler is not particularly limited, provided the recycler can recycle the toner cleaned by the cleaner, and known transporters can be used.

The controller is not particularly limited, provided the controller can control operations of the above-mentioned means, and a sequencer, a computer, etc. can be used.

Figure 3:
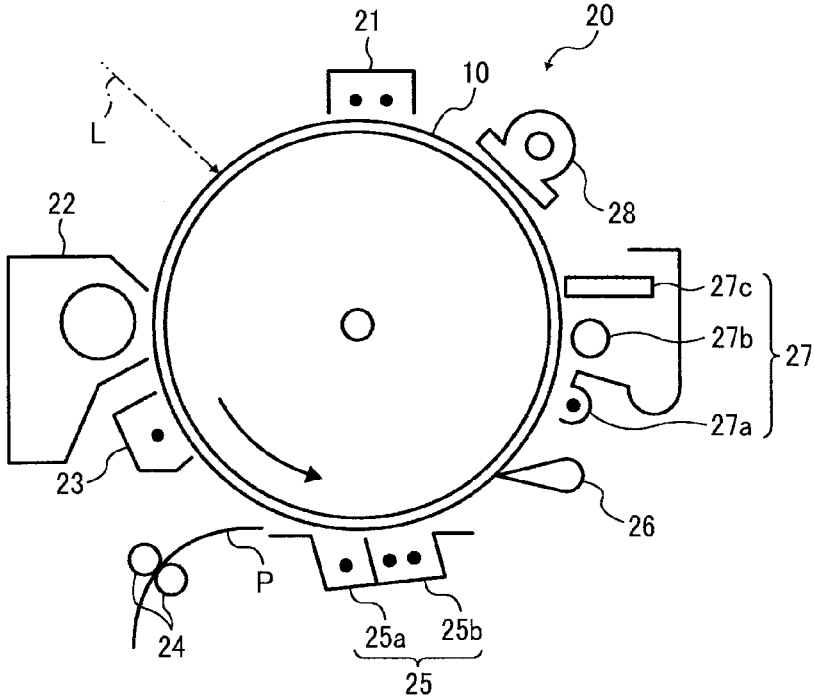
FIG. 3 is a schematic view illustrating an embodiment of the image forming apparatus of the present invention.

FIG. 3 is a schematic view illustrating an embodiment of the image forming apparatus of the present invention.

The image forming apparatus 20 includes a photoreceptor 10, a corona charger 21, an irradiator (not shown) irradiating light L to the photoreceptor 10, an image developer 22, a pre-transfer corona charger 23, a registration roller 24 feeding a recording paper P, a transferer 25, a separation click 36, a cleaner 27 and a discharge lamp 28. The transferer 25 includes a transfer corona charger 25*a* and a separation corona charger 25*b*. The cleaner 27 includes a pre-cleaning corona charger 27*a*, a brush 27*b* and a blade 27*c*.

The photoreceptor 10 has the shape of a drum, and may have the shape of a sheet or an endless belt.

The corona chargers include a corotron, a scorotron, a solid state charger, etc.

Specific examples of light sources for use in the irradiator and the discharge lamp 28 include, but are not limited to, fluorescent lamps, tungsten lamps, halogen lamps, mercury lamps, sodium lamps, LEDs, LDs, light sources using electroluminescence (EL), etc. In addition, in order to obtain light having a desired wave length range, filters such as sharp-cut filters, band pass filters, near-infrared cutting filters, dichroic filters, interference filters, color temperature converting filters, etc. can be used.

The imagewise light and discharging light may be irradiated through the electroconductive substrate 11 when being translucent.

A light source may be used instead of the pre-transfer corona charger 23, the transfer corona charger 25*a*, the separation corona charger 25*b* or the pre-cleaning corona charger 27*a*.

The brush 27*b* is not particularly limited, and a fur brush and a mag-fur brush can be used.

Figure 4:
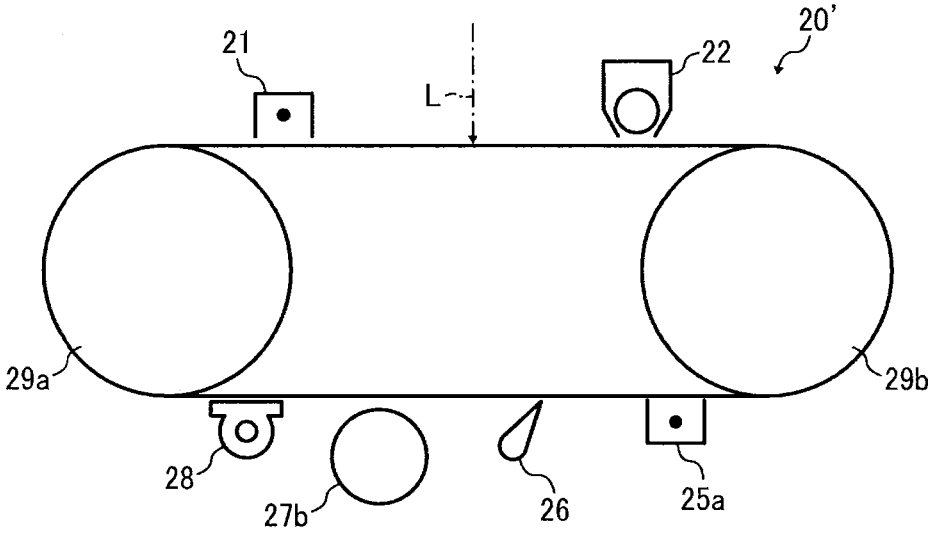
FIG. 4 is a schematic view illustrating another embodiment of the image forming apparatus of the present invention.

FIG. 4 is a schematic view illustrating another embodiment of the image forming apparatus of the present invention.

An image forming apparatus 20' has the same configurations as those of the image forming apparatus 20 except that a photoreceptor having the shape of an endless belt is supported by a drive roller 29*a* and a support roller 29*b*, and that the pre-transfer corona charger 23, the separation corona charger 25*b*, the pre-cleaning corona charger 27*a* and the blade 27*c* are omitted.

The process cartridge of the present invention is not particularly limited, provided the process cartridge includes the photoreceptor of the present invention and one of the charger, the irradiator, the image developer, the transferer, the cleaner and the discharger and is detachable from image forming apparatus.

Figure 5:
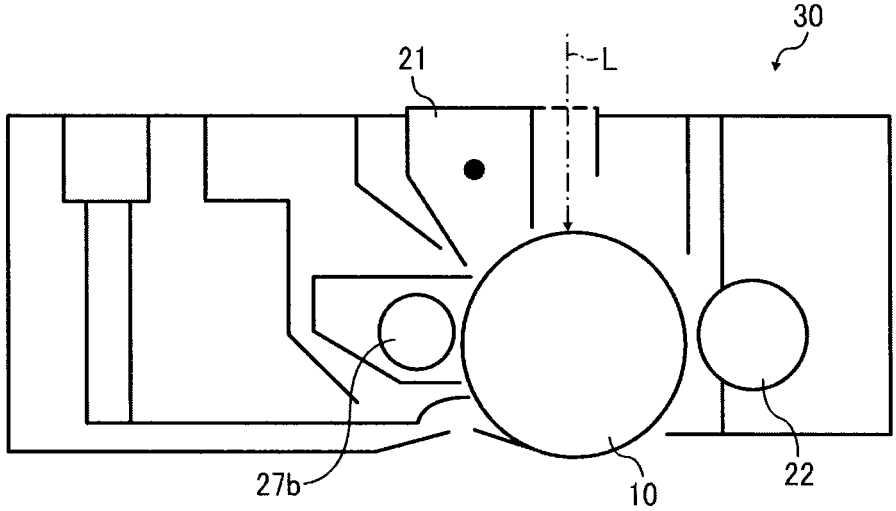
FIG. 5 is a schematic view illustrating an embodiment of the process cartridge of the present invention.

FIG. 5 is a schematic view illustrating an embodiment of the process cartridge of the present invention. In FIG. 5, the same components as those in FIG. 3 have the same numbers and explanations thereof are omitted.

A process cartridge integrally includes a drum-shaped photoreceptor 10, a corona charger 21, an image developer 22 and a brush 27*b*.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

An undercoat layer coating liquid including the following components was prepared.

| | |
|---|---|
| Particulate titanium oxide (Tipaque CR-EL from Ishihara Sangyo Kaisha Ltd.) | 400 |
| Melamine resin (Super Bekkamin G821-60 from Dainippon Ink And Chemicals, Inc.) | 65 |
| Alkyd resin (Bekkolite M6401-50 from Dainippon Ink And Chemicals, Inc.) | 120 |
| 2-butanon | 400 |

A charge generation layer coating liquid including the following components was prepared.

| | |
|---|---|
| Titanylphthalocyanine powder | 8 |
| Polyvinyl butyral (S-LEC BX-1 from Sekisui Chemical Co., Ltd.) | 5 |
| 2-butanone | 400 |

Figure 6:
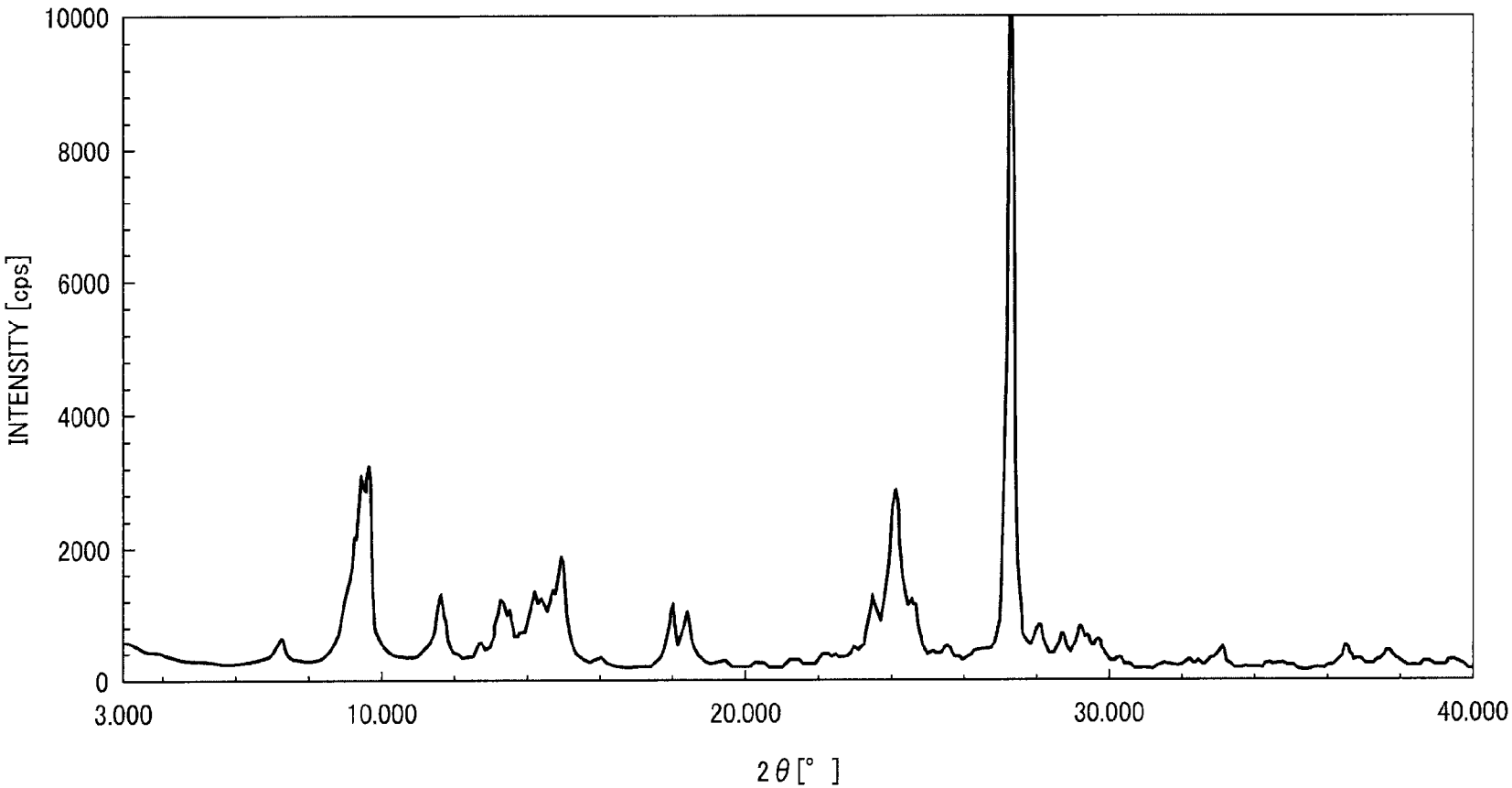
FIG. 6 is an X-ray diffraction spectrum of a titanylphthalocyanine powder.

FIG. 6 is an X-ray diffraction spectrum of the titanylphthalocyanine powder.

A charge transport layer coating liquid including the following components was prepared.

| | |
|---|---|
| Polycarbonate Z Polyca (from Teijin Chemicals Ltd.) | 10 |
| Charge transport material having the following formula | 9 |

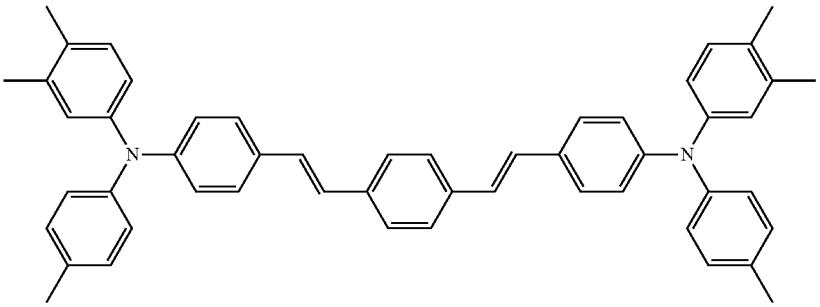

| | |
|---|---|
| Tetrahydrofuran | 100 |

A protection layer coating liquid including the following components was prepared.

| | |
|---|---|
| Tetrafunctional radical polymerizable compound having no charge transportable group and the following formula SR355 (from Sartomer Company Inc.) | 10 |

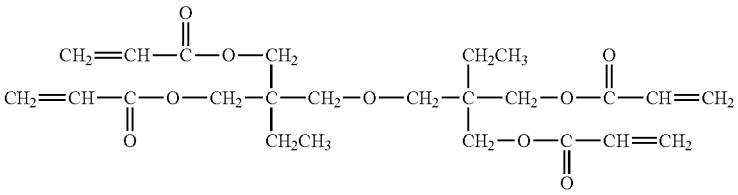

| | |
|---|---|
| Compound having the formula (1-1) | 5 |
| Compound having the formula (2-1) | 5 |
| Photopolymerization initiator 1-hydroxy-cyclohexyl-phenyl-ketone (Irgacure 184, from Ciba Specialty Chemicals) | 0.5 |
| Particulate alumina (AA-05 having an average primary particle diameter of 0.5 μm from Sumitomo Chemical Co., Ltd.) | 2 |
| Tetrahydrofuran | 100 |

The undercoat layer coating liquid, the charge generation layer coating liquid and the charge transport layer were coated and dried in this order on an aluminum cylinder to form an undercoat layer 3.5 μm thick, a charge generation layer 0.2 μm thick, a charge transport layer 23 μm thick thereon.

Next, the protection layer coating liquid was sprayed on the charge transport layer in a nitrogen stream, and left for 10 min therein to be dried to touch. Further, in a UV irradiating booth in which the air is replaced with a nitrogen gas to have an oxygen density not greater than 2%, an UV ray was irradiated by a metal halide lamp having a power of 160 W/cm to the surface for 60 sec at an irradiation distance of 120 mm and an irradiation intensity of 700 mW/cm$^2$. Then, the surface was dried at 130° C. for 20 min to form a protection layer 5 μm thick. Thus, a photoreceptor was prepared.

Example 2

The procedure for preparation of the photoreceptor in Example 1 was repeated except for replacing the compound having the formula (2-1) with the compound having the formula (2-2).

Example 3

The procedure for preparation of the photoreceptor in Example 1 was repeated except for replacing the compound having the formula (2-1) with the compound having the formula (2-3).

Example 4

The procedure for preparation of the photoreceptor in Example 1 was repeated except for replacing the compound having the formula (1-1) with the compound having the formula (1-2).

Example 5

The procedure for preparation of the photoreceptor in Example 2 was repeated except for replacing the compound having the formula (1-1) with the compound having the formula (1-2).

Example 6

The procedure for preparation of the photoreceptor in Example 3 was repeated except for replacing the compound having the formula (1-1) with the compound having the formula (1-2).

Example 7

The procedure for preparation of the photoreceptor in Example 1 was repeated except for replacing the compound having the formula (1-1) with the compound having the formula (1-3).

Example 8

The procedure for preparation of the photoreceptor in Example 2 was repeated except for replacing the compound having the formula (1-1) with the compound having the formula (1-3).

Example 9

The procedure for preparation of the photoreceptor in Example 3 was repeated except for replacing the compound having the formula (1-1) with the compound having the formula (1-3).

Example 10

The procedure for preparation of the photoreceptor in Example 1 was repeated except for replacing SR355 (from Sartomer Company Inc.) with a hexafunctional radical polymerizable compound having no charge transportable group and the following formula KAYARAD DPCA-120 (from Nippon Kayaku Co., Ltd.)

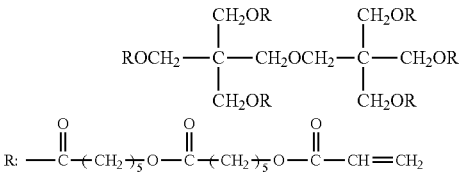

Example 11

The procedure for preparation of the photoreceptor in Example 1 was repeated except for replacing SR355 (from Sartomer Company Inc.) with a trifunctional radical polymerizable compound having no charge transportable group and the following formula KAYARAD TMPTA (from Nippon Kayaku Co., Ltd.)

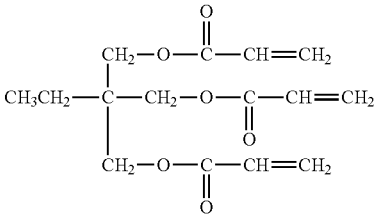

Example 12

The procedure for preparation of the photoreceptor in Example 1 was repeated except for replacing 10 parts of SR355 (from Sartomer Company Inc.) with 5 parts thereof and 5 parts of KAYARAD DPCA-120 (from Nippon Kayaku Co., Ltd.).

Example 13

The procedure for preparation of the photoreceptor in Example 1 was repeated except for replacing 10 parts of SR355 (from Sartomer Company Inc.) with 5 parts of KAYARAD DPCA-120 (from Nippon Kayaku Co., Ltd.) and 5 parts of KAYARAD TMPTA (from Nippon Kayaku Co., Ltd.).

Example 14

The procedure for preparation of the photoreceptor in Example 1 was repeated except for replacing 10 parts of SR355 (from Sartomer Company Inc.) with 5 parts thereof and 5 parts of KAYARAD TMPTA (from Nippon Kayaku Co., Ltd.).

Example 15

The procedure for preparation of the photoreceptor in Example 1 was repeated except for replacing the particulate alumina AA-05 with a particulate alumina AA-03 having an average primary particle diameter of 0.3 μm (from Sumitomo Chemical Co., Ltd.).

Example 16

The procedure for preparation of the photoreceptor in Example 1 was repeated except for replacing the particulate alumina AA-05 with a particulate titanium oxide CR97 having an average particle diameter of 0.25 μm (from Ishihara Sangyo Kaisha Ltd.).

Example 17

The procedure for preparation of the photoreceptor in Example 1 was repeated except for replacing the particulate alumina AA-05 with a particulate fluorine-containing resin MPE-056 (from Du Pont-Mitsui Fluorochemicals Co., Ltd.).

Example 18

The procedure for preparation of the photoreceptor in Example 1 was repeated except for not using the particulate alumina AA-05.

Example 19

The procedure for preparation of the photoreceptor in Example 1 was repeated except for replacing each 5 parts of the compound having the formula (1-1) and the compound having the formula (2-1) with 2 parts of the compound having the formula (1-1) and 8 parts of the compound having the formula (2-1).

Example 20

The procedure for preparation of the photoreceptor in Example 1 was repeated except for replacing each 5 parts of the compound having the formula (1-1) and the compound having the formula (2-1) with 4 parts of the compound having the formula (1-1) and 6 parts of the compound having the formula (2-1).

Example 21

The procedure for preparation of the photoreceptor in Example 1 was repeated except for replacing each 5 parts of the compound having the formula (1-1) and the compound having the formula (2-1) with 6 parts of the compound having the formula (1-1) and 4 parts of the compound having the formula (2-1).

Example 22

The procedure for preparation of the photoreceptor in Example 1 was repeated except for replacing each 5 parts of the compound having the formula (1-1) and the compound having the formula (2-1) with 8 parts of the compound having the formula (1-1) and 2 parts of the compound having the formula (2-1).

Example 23

The procedure for preparation of the photoreceptor in Example 1 was repeated except for replacing each 5 parts of the compound having the formula (1-1) and the compound having the formula (2-1) with 1 part of the compound having the formula (I-1) and 9 parts of the compound having the formula (2-1).

Example 24

The procedure for preparation of the photoreceptor in Example 1 was repeated except for replacing each 5 parts of the compound having the formula (1-1) and the compound having the formula (2-1) with 9 parts of the compound having the formula (1-1) and 1 part of the compound having the formula (2-1).

Example 25

The procedure for preparation of the photoreceptor in Example 1 was repeated except for replacing 10 parts of SR355 (from Sartomer Company Inc.) and each 5 parts of the compound having the formula (1-1) and the compound having the formula (2-1) with 4 parts of SR355 (from Sartomer Company Inc.), 14.4 parts of the compound having the formula (1-1) and 1.6 parts of the compound having the formula (2-1).

Example 26

The procedure for preparation of the photoreceptor in Example 1 was repeated except for replacing 10 parts of SR355 (from Sartomer Company Inc.) and each 5 parts of the compound having the formula (1-1) and the compound having the formula (2-1) with 8 parts of SR355 (from Sartomer Company Inc.), 10.8 parts of the compound having the formula (1-1) and 1.2 parts of the compound having the formula (2-1).

Example 27

The procedure for preparation of the photoreceptor in Example 1 was repeated except for replacing 10 parts of SR355 (from Sartomer Company Inc.) and each 5 parts of the compound having the formula (1-1) and the compound having the formula (2-1) with 12 parts of SR355 (from Sartomer Company Inc.), 7.2 parts of the compound having the formula (1-1) and 0.8 parts of the compound having the formula (2-1).

Example 28

The procedure for preparation of the photoreceptor in Example 1 was repeated except for replacing 10 parts of SR355 (from Sartomer Company Inc.) and each 5 parts of the compound having the formula (1-1) and the compound having the formula (2-1) with 16 parts of SR355 (from Sartomer Company Inc.), 3.6 parts of the compound having the formula (1-1) and 0.4 parts of the compound having the formula (2-1).

Example 29

The procedure for preparation of the photoreceptor in Example 1 was repeated except for replacing 10 parts of SR355 (from Sartomer Company Inc.) and each 5 parts of the compound having the formula (1-1) and the compound having the formula (2-1) with 18 parts of SR355 (from Sartomer Company Inc.), 1.8 parts of the compound having the formula (1-1) and 0.2 parts of the compound having the formula (2-1).

Example 30

The procedure for preparation of the photoreceptor in Example 1 was repeated except for replacing 10 parts of SR355 (from Sartomer Company Inc.) and each 5 parts of the compound having the formula (1-1) and the compound having the formula (2-1) with 2 parts of SR355 (from Sartomer Company Inc.), 16.2 parts of the compound having the formula (1-1) and 1.8 parts of the compound having the formula (2-1).

Comparative Example 1

The procedure for preparation of the photoreceptor in Example 1 was repeated except for not forming the protection layer and changing the thickness of the charge transport layer to 28 μm.

Comparative Example 2

The procedure for preparation of the photoreceptor in Example 1 was repeated except for replacing each 5 parts of the compound having the formula (1-1) and the compound having the formula (2-1) with 10 parts of the compound having the formula (1-1).

Comparative Example 3

The procedure for preparation of the photoreceptor in Example 1 was repeated except for replacing the compound having the formula (2-1) with a compound having the following formula.

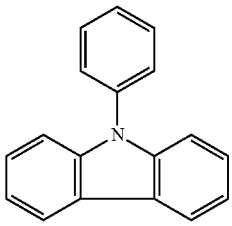

Comparative Example 4

The procedure for preparation of the photoreceptor in Example 1 was repeated except for replacing the compound having the formula (2-1) with a compound having the following formula.

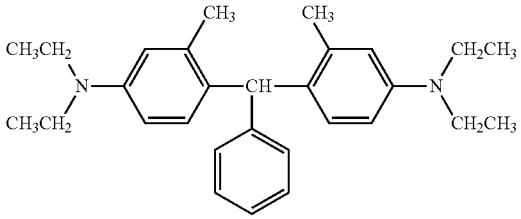

Comparative Example 5

The procedure for preparation of the photoreceptor in Example 1 was repeated except for replacing the compound having the formula (2-1) with a difunctional radical polymerizable compound having a charge transportable group and the following formula.

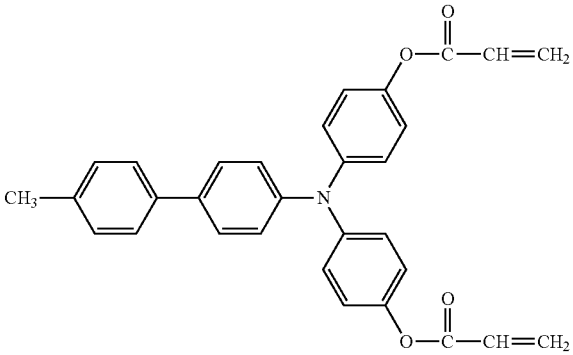

Comparative Example 6

The procedure for preparation of the photoreceptor in Example 1 was repeated except for replacing SR355 (from Sartomer Company Inc.) with a difunctional radical polymerizable compound having a charge transportable group 1,6-hexanedioldiacrylate (from Wako Pure Chemical Industries, Ltd.) having the following formula.

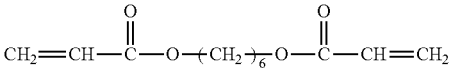

Comparative Example 7

The procedure for preparation of the photoreceptor in Example 1 was repeated except for replacing SR355 (from Sartomer Company Inc.) with a difunctional radical polymerizable compound having a charge transportable group SR349 (from Sartomer Company Inc.) having the following formula.

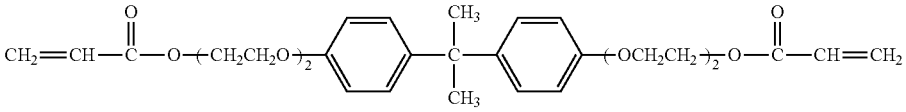

Comparative Example 8

The procedure for preparation of the photoreceptor in Comparative Example 2 was repeated except for further adding 0.2 parts of bisphenol Z-type polycarbonate TS2020 (from Teijin Ltd.) to the protection layer coating liquid.

Comparative Example 9

The procedure for preparation of the photoreceptor in Comparative Example 2 was repeated except for further adding 2 parts of bisphenol Z-type polycarbonate TS2020 (from Teijin Ltd.) to the protection layer coating liquid.

Comparative Example 10

The procedure for preparation of the photoreceptor in Comparative Example 2 was repeated except for further adding 4 parts of bisphenol Z-type polycarbonate TS2020 (from Teijin Ltd.) to the protection layer coating liquid.

Next, uneven image density of the images produced by the photoreceptors prepared in Examples 1 to 30 and Comparative Examples 1 to 10, and gas resistance thereof were evaluated.

(Uneven Image Density)

In an environment of 15° C. and 20% RH, a charger and the photoreceptor discharged for 200 hrs or more were installed in a black station of a full-color printer RICOH Pro C900 to evaluate uneven image density. Specifically, first, 20,000 monochrome black test charts were produced, and the image forming apparatus was turned off and left for 24 hrs. Next, the image forming apparatus was turned on to produce a 2 by 2 monochrome black solid halftone image of 1,200 dpi, and uneven image density of a part thereof equivalent to a width of the charger was visually evaluated under the following standard.

Excellent: No uneven image density

Good: Slight uneven image density, but acceptable in practical use

Poor: Unacceptable uneven image density (Gas Resistance)

The photoreceptor was exposed in an atmosphere in which NO and $NO_2$ respectively had concentrations of 50 ppm for 72 hrs to evaluate the gas resistance with NOx exposure tester (from Tokyo Dylec Corp.).

Next, a charger and the photoreceptor discharged for 200 hrs or more were installed in a black station of a full-color printer RICOH Pro C900 to visually evaluate blurred image under the following standard.

Excellent: No blurred image

Good: Slight blurred image, but acceptable in practical use

Poor: Unacceptable blurred image (Durability)

In an environment of normal temperature and normal humidity, a charger and the photoreceptor discharged for 200 hrs or more were installed in a black station of a full-color printer RICOH Pro C900, and 200,000 monochrome black test charts were produced to determine an abrasion amount of the protection layer from the thickness thereof before and after the 200,000 test charts were produced. The surface scratch was also visually evaluated. Further, a solid image was produced to visually observe image density and blurred image.

The evaluation results of the photoreceptors are shown in Tables 1 and 2.

TABLE 1

| | Uneven Image Density | Gas Resistance | Durability: Abrasion amount [μm] | Durability: Surface Scratch · Image Density · Blurred Image |
|---|---|---|---|---|
| Example 1 | Excellent | Excellent | 1.1 | Good |
| Example 2 | Excellent | Excellent | 1.2 | Good |
| Example 3 | Excellent | Excellent | 1.3 | Good |
| Example 4 | Excellent | Excellent | 1.2 | Slight blurred image |
| Example 5 | Excellent | Excellent | 1.4 | Slight blurred image |
| Example 6 | Excellent | Excellent | 1.1 | Slight blurred image |
| Example 7 | Excellent | Excellent | 1.3 | Good |
| Example 8 | Excellent | Excellent | 0.9 | Good |
| Example 9 | Excellent | Excellent | 1.1 | Good |
| Example 10 | Excellent | Good | 0.9 | Slight scratch<br>Image density slightly lowered |
| Example 11 | Excellent | Excellent | 1.1 | Slight scratch |
| Example 12 | Excellent | Excellent | 0.6 | Good |
| Example 13 | Excellent | Excellent | 0.7 | Good |
| Example 14 | Excellent | Excellent | 0.7 | Good |
| Example 15 | Excellent | Excellent | 1.3 | Image density slightly lowered |
| Example 16 | Excellent | Good | 1.5 | Slight blurred image |
| Example 17 | Excellent | Excellent | 1.5 | Image density slightly lowered |
| Example 18 | Excellent | Good | 1.8 | Slight scratch |
| Example 19 | Excellent | Good | 2.1 | Slight scratch |
| Example 20 | Excellent | Good | 2.1 | Slight scratch<br>Slight blurred image |

TABLE 2

| | Uneven Image Density | Gas Resistance | Durability: Abrasion amount [μm] | Durability: Surface Scratch · Image Density · Blurred Image |
|---|---|---|---|---|
| Example 21 | Excellent | Good | 2.3 | Slight scratch<br>Slight blurred image |
| Example 22 | Excellent | Good | 2.4 | Slight blurred image |
| Example 23 | Excellent | Good | 2.5 | Slight scratch |
| Example 24 | Excellent | Good | 1.9 | Slight blurred image |
| Example 25 | Excellent | Good | 2.5 | Slight scratch |
| Example 26 | Excellent | Good | 2.3 | Slight scratch |
| Example 27 | Excellent | Good | 2.2 | Slight blurred image |
| Example 28 | Excellent | Good | 2.0 | Slight blurred image |
| Example 29 | Excellent | Good | 2.0 | Slight blurred image |
| Example 30 | Excellent | Good | 2.8 | Slight scratch |
| Comparative Example 1 | Good | Poor | 4.5 | Many stripe scratches<br>Noticeable blurred image |
| Comparative Example 2 | Poor | Poor | 1.2 | Rough blurred image |
| Comparative Example 3 | Poor | Poor | 1.4 | Rough blurred image |
| Comparative Example 4 | Poor | Poor | 1.6 | Rough blurred image |
| Comparative Example 5 | Good | Poor | 0.9 | Many minute scratches |
| Comparative Example 6 | Good | Poor | 3.7 | Many stripe scratches<br>Noticeable blurred image |
| Comparative Example 7 | Good | Good | 3.5 | Many stripe scratches<br>Slight blurred image |
| Comparative Example 8 | Poor | Poor | 1.2 | Rough blurred image |
| Comparative Example 9 | Poor | Good | 2.2 | Scratches<br>Rough blurred image |
| Comparative Example 10 | Good | Good | 3.4 | Many stripe scratches<br>Slight blurred image |

Tables 1 and 2 shows the photoreceptors prepared in Examples 1 to 30 have no uneven image density, and good gas resistance and durability.

The photoreceptor prepared in Comparative Example 1 deteriorates in durability and gas resistance because of having no protection layer.

Each of the photoreceptors prepared in Comparative Examples 2 to 4 deteriorates in image density and gas resistance because of not including the compound having the formula (2-1) in its protection layer.

The photoreceptor prepared in Comparative Example 5 deteriorate in gas resistance because of using a difunctional radical polymerizable compound having a group in which two hydrogen atoms are removed from triarylamine instead of the compound having the formula (2-1).

Each of the photoreceptors prepared in Comparative Examples 6 to 7 deteriorates in durability because of using a difunctional radical polymerizable compound having no charge transportable group instead of the tetrafunctional radical polymerizable compound having no charge transportable group.

Each of the photoreceptors prepared in Comparative Examples 8 to 10 further including the bisphenol Z-type polycarbonate in its protection layer which is the same as that of the photoreceptor prepared in Comparative Example 2 improves in gas resistance, but deteriorates in durability.

Having now fully described the invention, it will be apparent to one of ordinary skill in the art that many changes and modifications can be made thereto without departing from the spirit and scope of the invention as set forth therein.

What is claimed is:

1. A photoreceptor, comprising:

an electroconductive substrate;

a photosensitive layer overlying the electroconductive substrate; and a protection layer overlying the photosensitive layer, wherein the protection layer comprises:

a crosslinked product of a radical polymerizable compound having three or more radical polymerizable groups without a charge transportable group and a compound having formula (1):

(1)

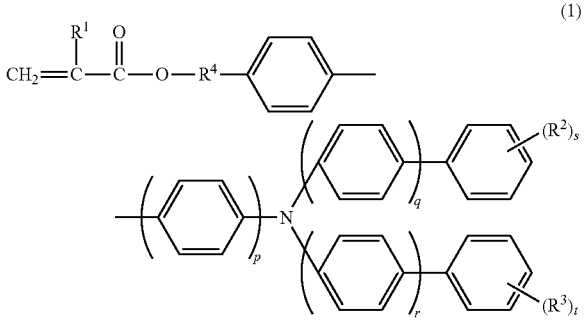

wherein p, q and r independently represent an integer of from 0 to 2; s and t independently represent an integer of from 0 to 3; $R^1$ represents a hydrogen atom or a methyl group; $R^2$ and $R^3$ independently represent an alkyl group having 1 to 5 carbon atoms wherein plural $R^2$ may be different from each other when s is 2 or 3 and $R^3$ may be different from each other when t is 2 or 3; and $R^4$ represents a single bond, a methylene group, an ethylene group, an ethyleneoxy group, a 2-methylethyleneoxy group or a phenyleneethylene group; and a compound having formula (2):

(2)

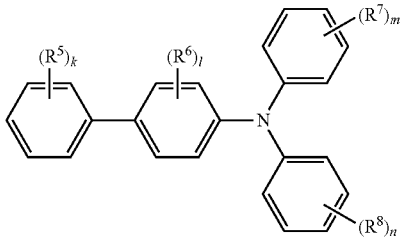

wherein $R^5$, $R^7$ and $R^8$ independently represent a hydrogen atom, an amino group, an alkoxy group, a thioalkoxy group, an aryloxy group, a methylenedioxy group, an alkyl group optionally having a substituent, a halo group or an aryl group optionally having a substituent; $R^6$ represents a hydrogen atom, an alkoxy group, an alkyl group optionally having a substituent or a halo group; k, l, m and n independently represent an integer of from 1 to 4wherein plural $R^5$ may be different from each other when k is an integer of from 2 to 4, plural $R^6$ may be different from each other when l is an integer of from 2 to 4, plural $R^7$ may be different from each other when m is an integer of from 2 to 4 and plural $R^8$ may be different from each other when n is an integer of from 2 to 4.

2. The photoreceptor of claim 1, wherein a ratio of the total weight of the compound having the formula (1) and the compound having the formula (2) to the weight of the radical polymerizable compound is from 0.2 to 4.

3. The photoreceptor of claim 1, wherein a weight ratio of the compound having the formula (2) to the compound having the formula (1) is from 0.2 to 4.

4. The photoreceptor of claim 1, wherein the composition further comprises an inorganic particulate material and a particulate resin.

5. The photoreceptor of claim 1, wherein the crosslinked product of the protection layer is formed by crosslinking via light or an electron beam.

6. A method of preparing a photoreceptor comprising an electroconductive substrate; a photosensitive layer overlying the electroconductive substrate; and a protection layer overlying the photosensitive layer, comprising:

coating a coating liquid on the photosensitive layer, comprising a composition comprising a radical polymerizable compound having three or more radical polymerizable groups without a charge transportable group, a compound having the following formula (1):

(1)

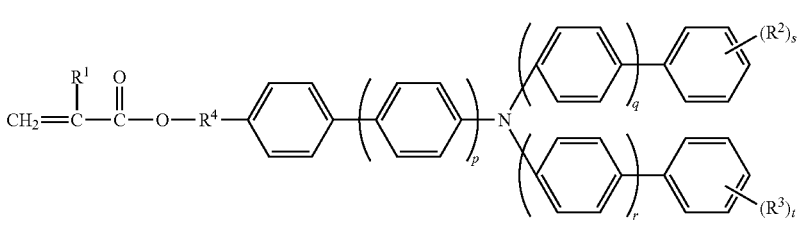

wherein p, q and r independently represent an integer of from 0 to 2; s and t independently represent an integer of from 0 to 3; $R^1$ represents a hydrogen atom or a methyl group; $R^2$ and $R^3$ independently represent an alkyl group having 1 to 5 carbon atoms wherein plural $R^2$ may be different from each other when s is 2 or 3 and $R^3$ may be different from each other when t is 2 or 3; and $R^4$ represents a single bond, a methylene group, an ethylene group, an ethyleneoxy group, a 2-methylethyleneoxy group or a phenyleneethylene group, and a compound having the following formula (2):

(2)

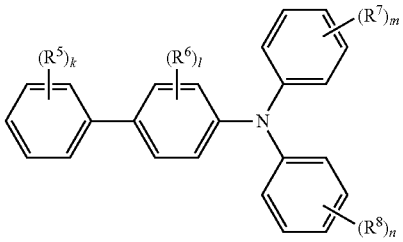

wherein $R^5$, $R^7$ and $R^8$ independently represent a hydrogen atom, an amino group, an alkoxy group, a thioalkoxy group, an aryloxy group, a methylenedioxy group, an alkyl group optionally having a substituent, a halo group or an aryl group optionally having a substituent; $R^6$ represents a hydrogen atom, an alkoxy group, an alkyl group optionally having a substituent or a halo group; k, l, m and n independently represent an integer of from 1 to 4wherein plural $R^5$ may be different from each other when k is an integer of from 2 to 4, plural $R^6$ may be different from each other when l is an integer of from 2 to 4, plural $R^7$ may be different from each other when m is an integer of from 2 to 4 and plural $R^8$ may be different from each other when n is an integer of from 2 to 4; and irradiating the coating liquid coated on the photosensitive layer with light or an electron beam such that the composition comprising the radical polymerizable compound, the compound having the formula (1) and the compound having the formula (2) are crosslinked to form the protection layer thereon.

7. An image forming apparatus, comprising:

the photoreceptor according to claim 1;

a charger configured to charge the photoreceptor;

an irradiator configured to irradiate the charged photoreceptor to form an electrostatic latent image thereon;

an image developer configured to develop the electrostatic latent image formed on the photoreceptor with a toner to form a toner image; and a transferer configured to transfer the toner image formed on the photoreceptor to a recording medium.

8. A process cartridge detachable from image forming apparatus, comprising the photoreceptor according to claim 1 and one of a charger, an irradiator, an image developer, a transferer, a cleaner and a discharger.

9. The photoreceptor of claim 1, wherein the compound of formula (1) is selected from the group consisting of formula (1-1), formula (1-2) and formula (1-3):

(1-1)

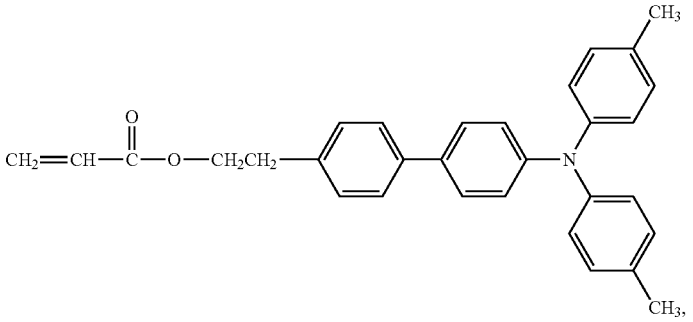

(1-2)

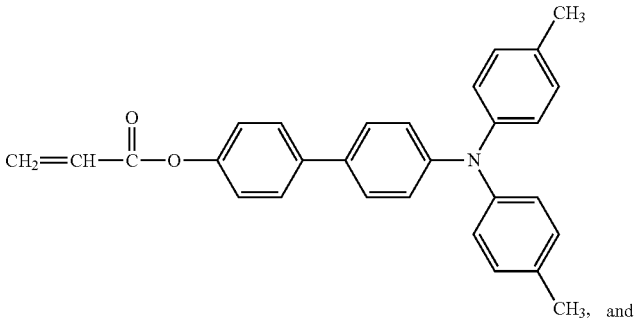

and (1-3)

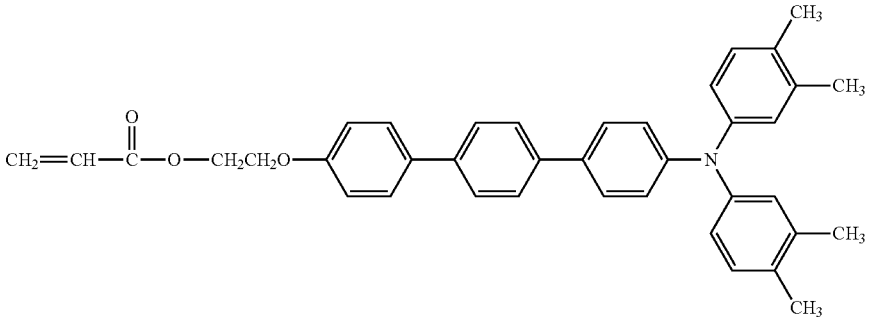

10. The photoreceptor of claim 1, wherein the compound of formula (2) is selected from the group consisting of formula (2-1), formula (2-2) and formula (2-3):
(2-1)
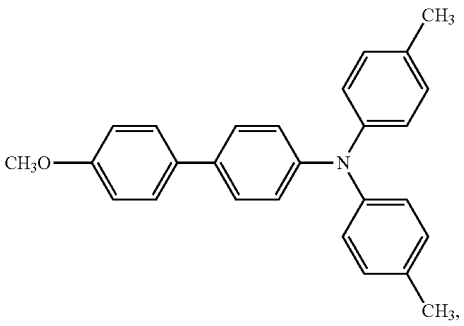
(2-2)
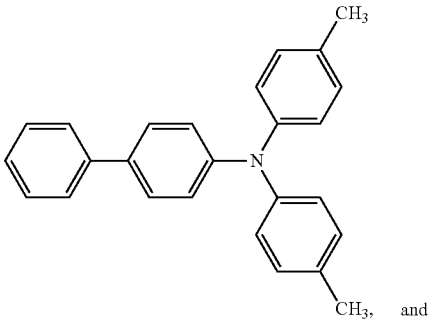
and
-continued
(2-3)
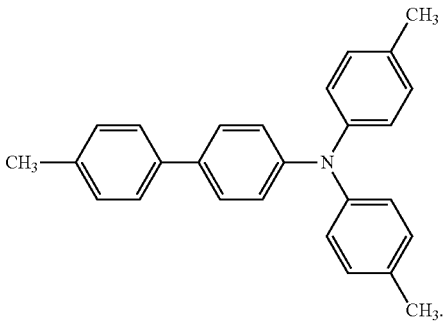
* * * * *